United States Patent [19]

Adams

[11] 4,334,570

[45] Jun. 15, 1982

[54] FIRE AND SMOKE DAMPER

[75] Inventor: Rudolph J. Adams, Chicopee, Mass.

[73] Assignee: Reed National Corp., Westfield, Mass.

[21] Appl. No.: 189,603

[22] Filed: Sep. 22, 1980

[51] Int. Cl.[3] ..... E05F 15/20

[52] U.S. Cl. ..... 160/1

[58] Field of Search ..... 160/1, 5, 6, 84 R

[56] References Cited

U.S. PATENT DOCUMENTS

| | | | |
|---|---|---|---|
| 3,580,321 | 5/1971 | Root | 160/1 |
| 3,646,877 | 3/1972 | Ellis | 160/1 |
| 3,665,996 | 5/1972 | Roberts | 160/1 |
| 3,752,208 | 8/1973 | Roberts | 160/1 |
| 3,866,656 | 2/1975 | McCabe | 160/1 |
| 4,161,204 | 7/1979 | Kurz | 160/1 |

*Primary Examiner*—Peter M. Caun

*Attorney, Agent, or Firm*—Chapin, Neal & Dempsey

[57] ABSTRACT

A motorized fire and smoke damper for an air passage is disclosed. The damper includes a wrap spring clutch used to automatically open and close a multifold curtain to define an opening in the passage. The clutch is normally connected to a stationary member by a fusible link, which restrains a portion of the clutch to enable the clutch to transmit torque to rotate a windup pulley and thereby raise or open the curtain. In the event of fire, the fusible link melts, whereupon the spring clutch no longer transmits torque and the pulley automatically freewheels to lower or close a raised curtain under its own weight or by spring bias. The passage opening is then closed. When desired, the air passage can be reopened by energizing the clutch to rotate it until it engages an adjacent finger, at which point the spring clutch can again transmit torque to the pulley and open the curtain.

10 Claims, 12 Drawing Figures

10

20
16
26
5
86
5
44
74
32
34
42
40
22
36
14
12
46
15

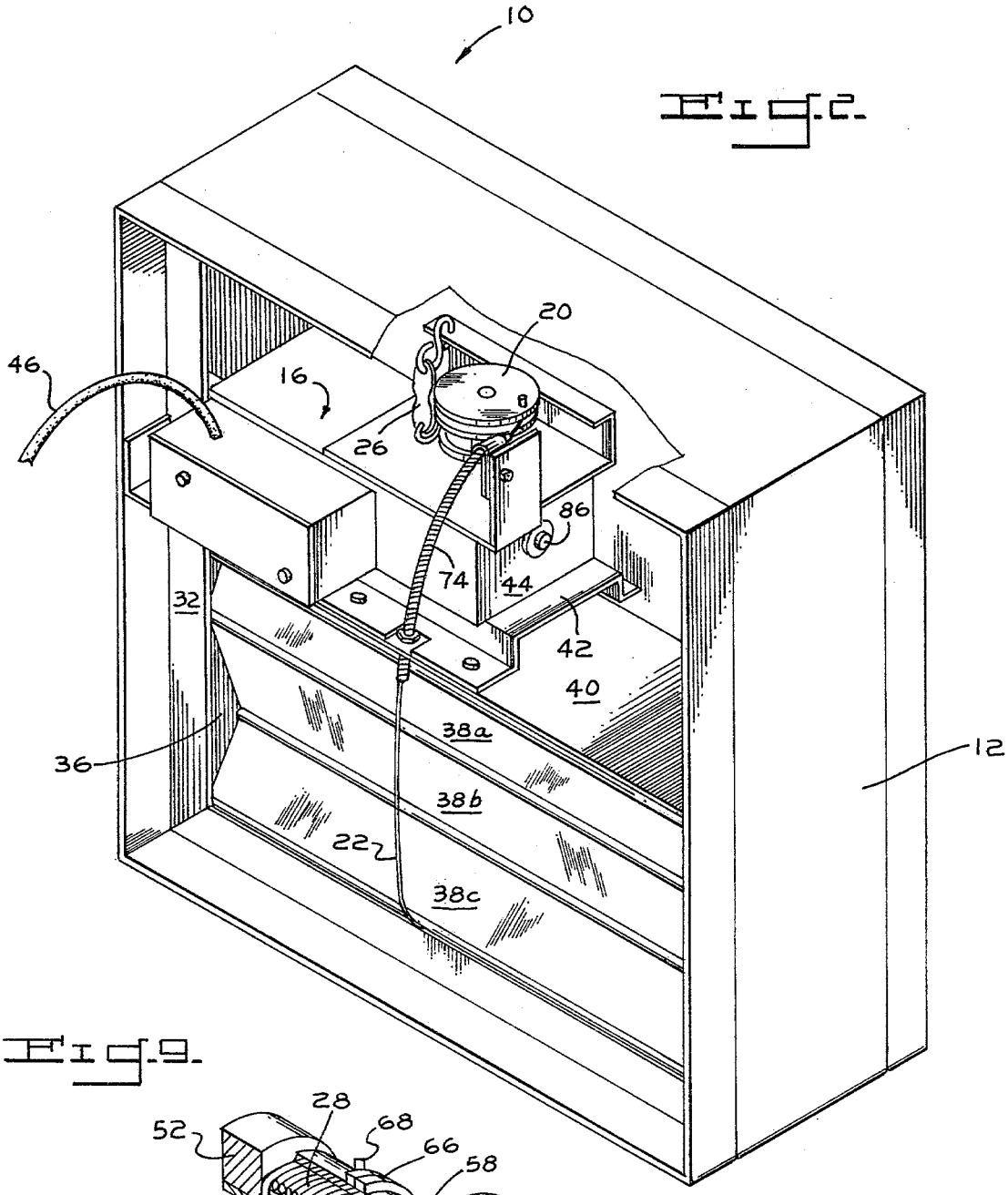
Fig. 2.
Fig. 9.
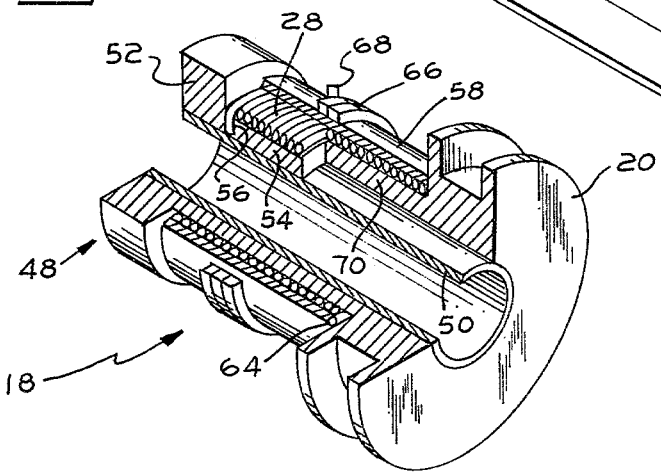

Fig. 10.
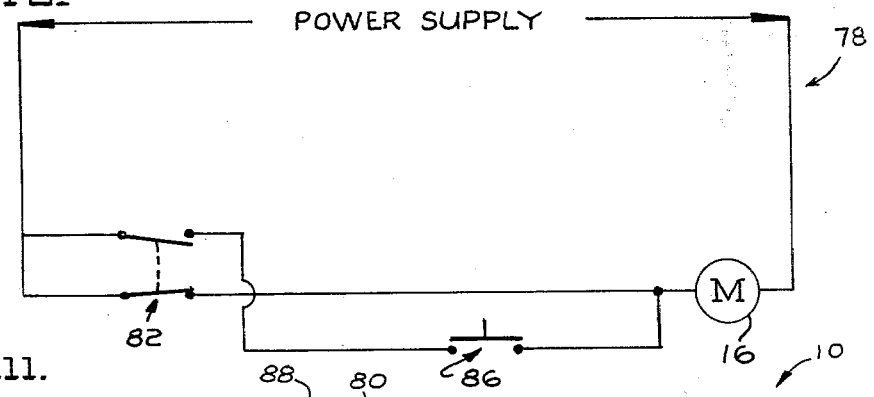
Fig. 11.
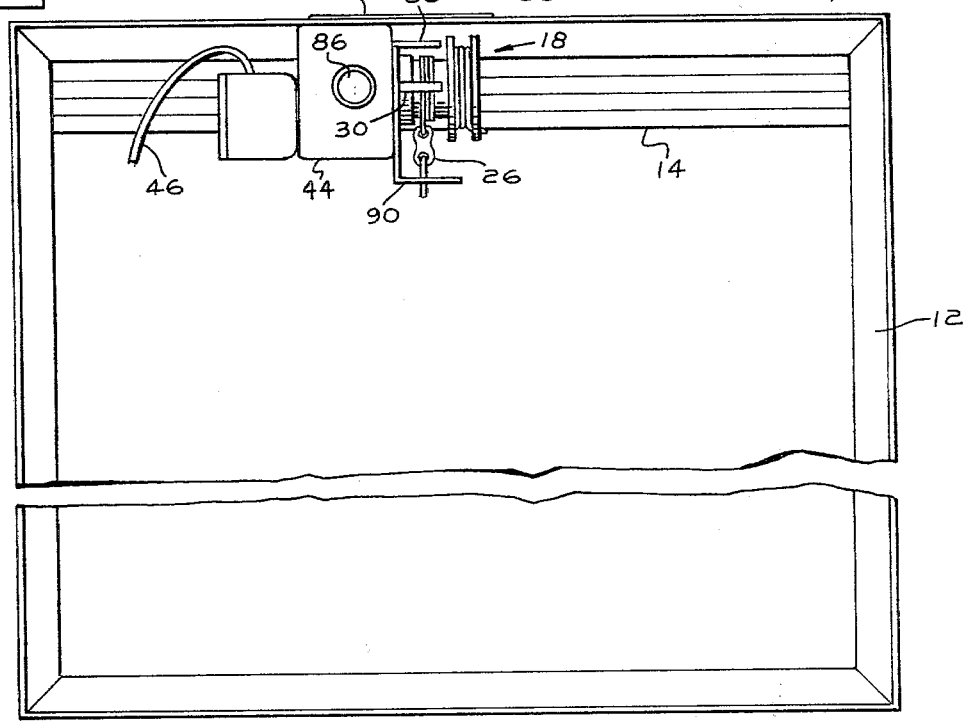
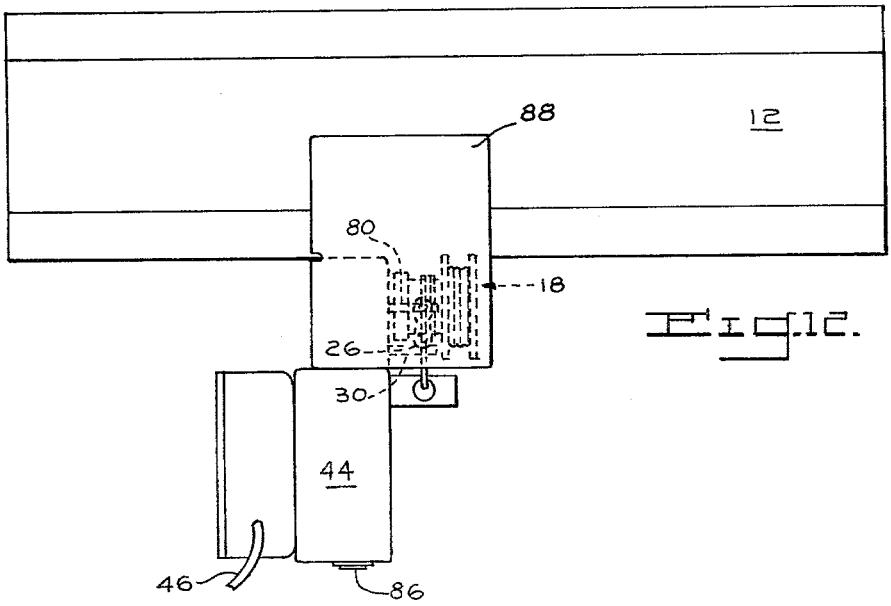
Fig. 12.

FIRE AND SMOKE DAMPER

BACKGROUND OF THE INVENTION

This invention relates to fire and smoke dampers and more particularly to motorized dampers that are installed in air ducts, wall partitions, slot openings and the like and are designed to automatically close in the event of fire or extreme heat conditions.

Fire and smoke dampers have long been employed in ventilation, heating and air conditioning for the purpose of automatically closing the ductwork or an air passageway in the event of fire so as to prevent the spread of the fire and smoke through a building. Such automatic dampers generally comprise a curtain or shutter which is normally retained in an open position by a mechanical catch system which is automatically released when the temperature reaches a predetermined value.

Almost invariably, fire and smoke dampers have employed fusible links to effect automatic damper closure. For example, one known fire damper, shown in U.S. Pat. No. 4,161,204, has employed a fusible link in a cable that normally lifts a multifold curtain to a maintained open position. When there is a fire, the link fuses whereupon the cable separates into two portions and the raised curtain drops to close the damper. Unfortunately, once the fusible link melts, the damper is not automatically reopenable. The fusible link must be replaced, and the appurtenant cable repositioned before the curtain can be automatically lifted.

SUMMARY OF THE INVENTION

The present invention basically comprises a motorized fire and smoke damper which is selectively opened and closed by a foldable curtain or by a shutter. The curtain is raised by an electric motor which rotatably drives a spring clutch, which in turn rotates a pulley to wind a cable thereon which is operably attached to the curtain. A fusible link interconnects a portion of the spring clutch to a stationary member so as to permit the spring clutch to wrap around a hub portion of the pulley and transmit torque from the motor to the pulley to wind the cable and raise the curtain.

In a fire, the fusible link will melt, whereupon the spring clutch unwinds and no longer transmits torque to the pulley. When the spring clutch unwinds, the pulley freewheels and the curtain drops under its own weight or by spring bias, unwinding the cable from the pulley. The curtain closing prevents the fire and smoke from spreading through the duct into adjacent rooms.

When it is desired to reopen the duct, as where the building is to be cleared of smoke, the motor is energized causing the spring clutch to rotate until a portion of the spring contacts an adjacent finger. Continued actuation of the motor tightens the spring clutch causing it to rotate the pulley and raise the curtain.

Accordingly, it is the principal object of this invention to provide a motorized fire and smoke damper which is automatically closable in the event of fire and which is automatically reopenable upon demand.

It is another object of this invention to provide a fusible link for interconnecting a clutch spring and stationary member in a motorized fire and smoke damper, so as to permit the clutch spring to become detached from the stationary member in the event of fire, whereby the damper will automatically close.

It is a further object to provide an automatically closable and reopenable fire and smoke damper that is simple and economical in construction, yet safe and effective to use.

The above and other objects and advantages of this invention will become more readily apparent when the following description is read in conjunction with the accompanying drawings.

BRIEF DESCRIPTION OF THE DRAWINGS

FIG. 2 is a perspsective view of the FIG. 1 fire damper in a closed position;

FIG. 9 is a fragmentary, perspective view of the spring clutch;

FIG. 10 is a schematic of circuitry used in the present invention to maintain the curtain in a closed position after the link has broken and to subsequently reopen the curtain when desired;

FIG. 11 is a front plan view of a modified and preferred embodiment of the present invention; and FIG. 12 is a top plan view of the embodiment of FIG. 11.

DETAILED DESCRIPTION OF THE PREFERRED EMBODIMENTS

Figure 1:
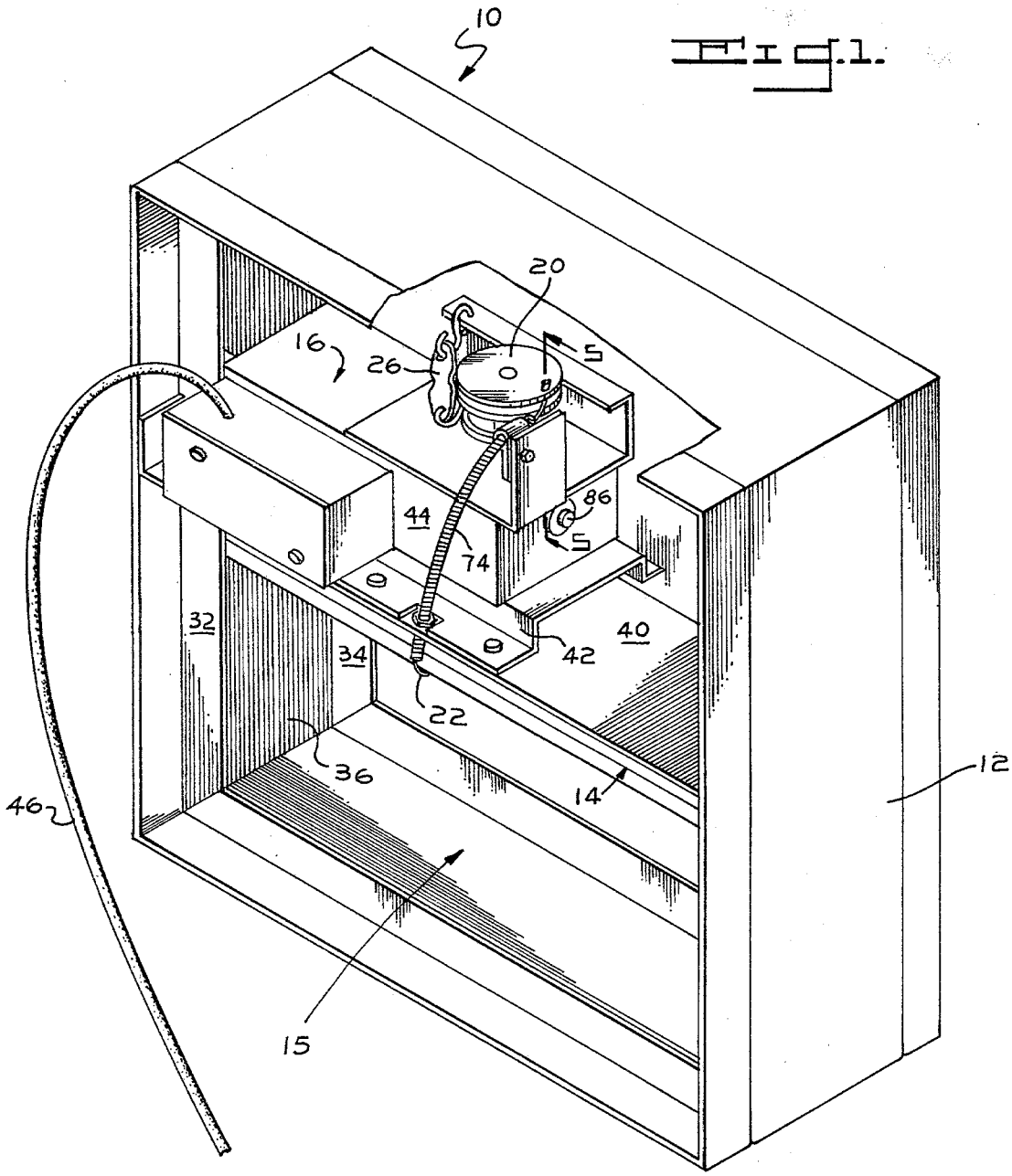
FIG. 1 is a fragmentary, perspective view of an opened fire damper constructed in accordance with the present invention.
Figure 3:
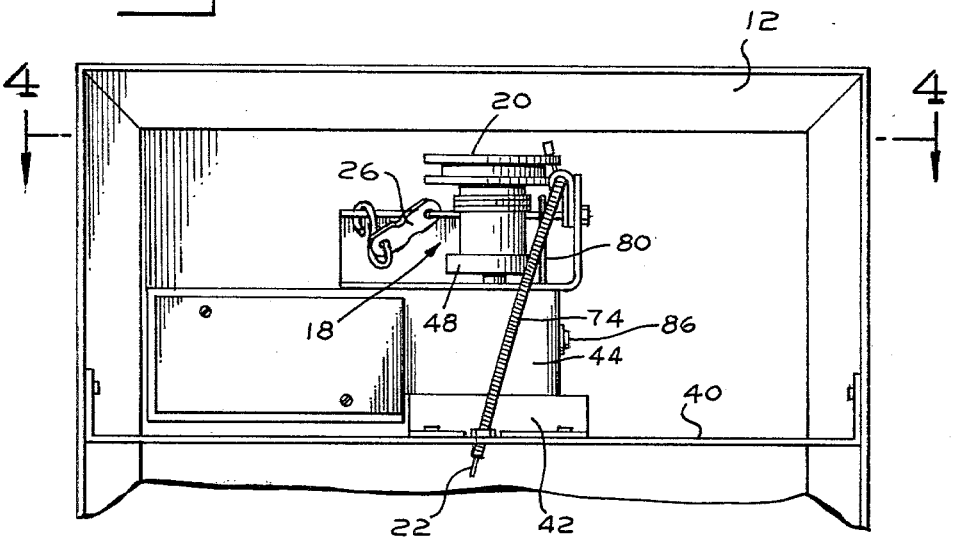
FIG. 3 is a fragmentary, elevational view of the FIG. 1 damper which illustrates a one-way torque spring clutch connected to the damper frame by a fusible link.
Figure 4:
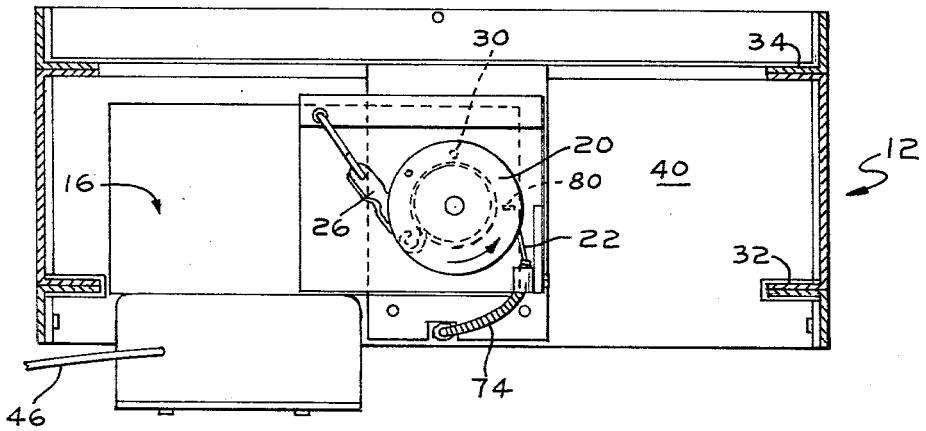
FIG. 4 is a cross-sectional view taken along line 4—4 of FIG. 3.
Figure 5:
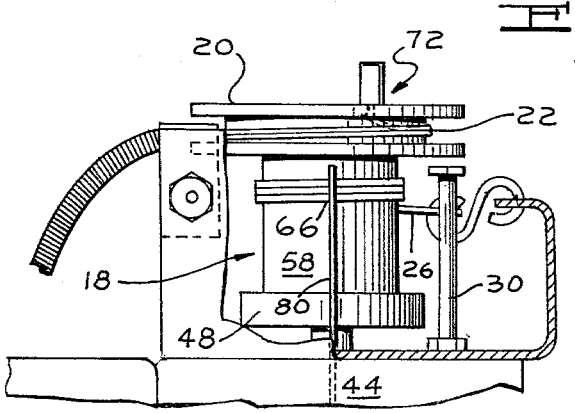
FIG. 5 is an enlarged plan view of the spring clutch and an associated finger taken along line 5—5 of FIG. 1, with the bracket broken away for clarity.
Figure 6:
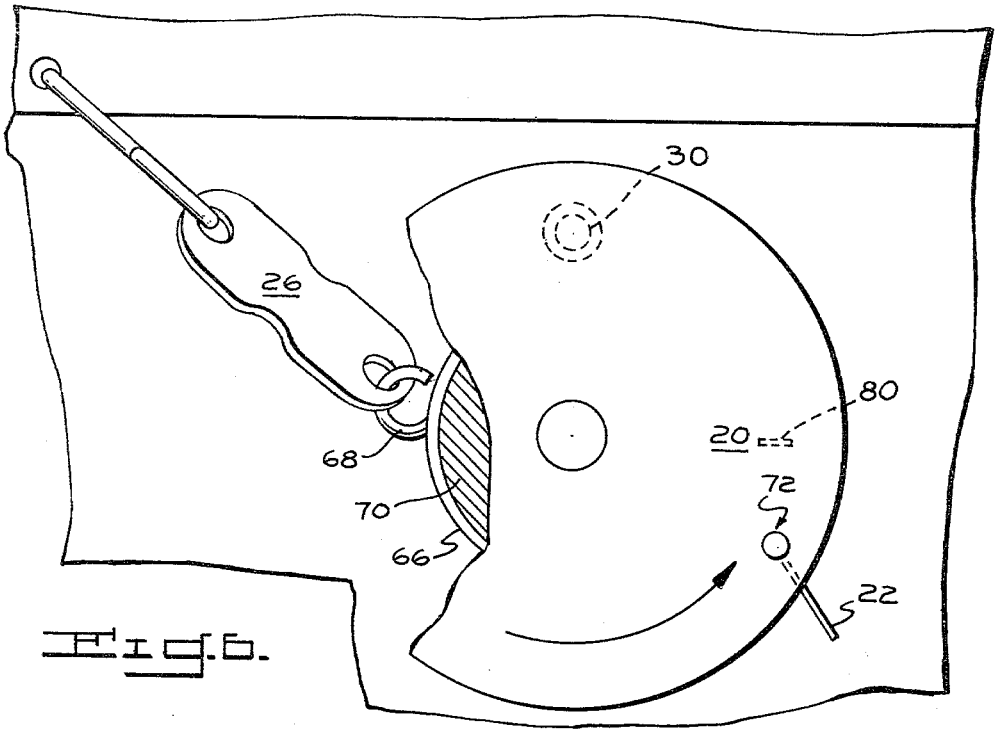
FIG. 6 is an enlarged, top plan view of the spring clutch and fusible link, with portions of an associated pulley broken away for clarity.
Figure 7:
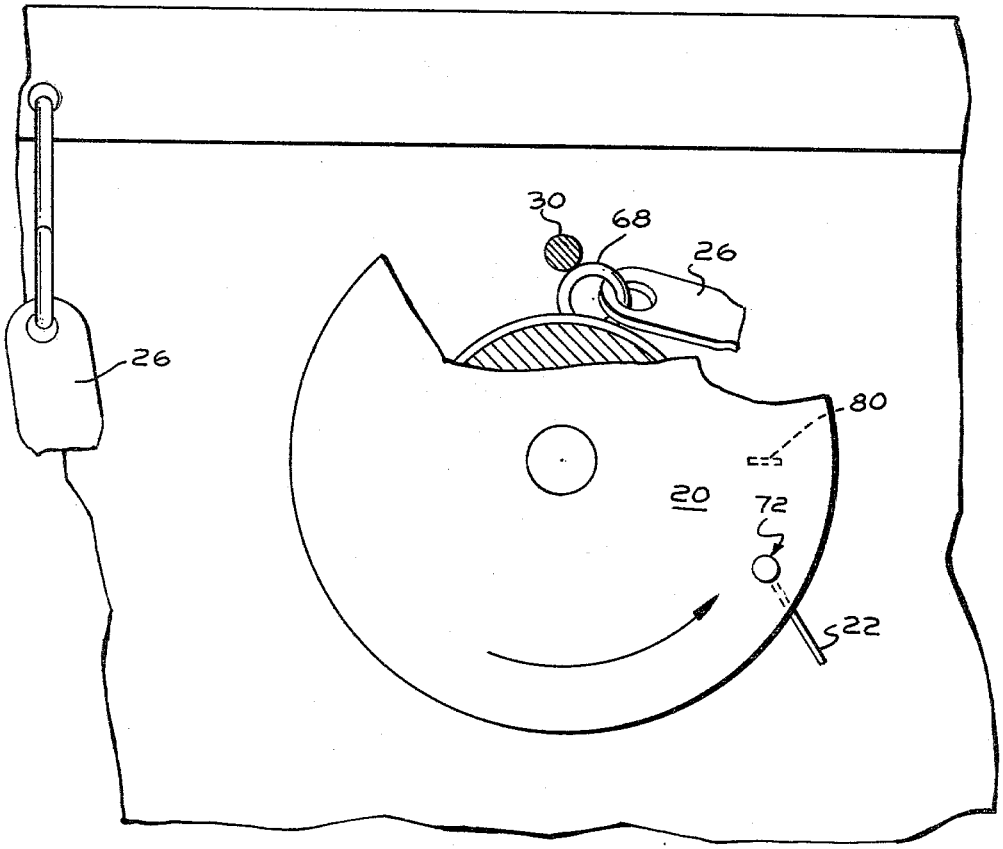
FIG. 7 is a top plan view similar to FIG. 6, but with the fusible link being broken and the spring clutch engaging the finger of FIG. 5.

Referring to the drawings in detail, a motorized smoke and fire damper is shown in FIGS. 1–9 and generally designated by the reference numeral 10. The damper includes a frame 12 suitable for mounting in an air duct (not shown) and a foldable curtain 14 movable within the frame to either a raised, folded position which defines a damper opening 15 (see FIG. 1) or an unfolded, lowered position wherein the damper opening is closed (see FIG. 2). The curtain 14 is automatically raised by a motor 16 adapted to drivingly rotate a wrap spring clutch 18, which in turn rotates a pulley 20. As the pulley rotates, a cable 22, looped around the bottom 24 of curtain 14, winds around the pulley, moves upwards, and lifts the curtain 14. A fusible link 26 normally interconnects the wrap spring clutch 18 to the frame 12 to permit a coil spring 28 of the clutch to tighten around a portion of the pulley 20 and transmit torque from the motor to the pulley. The link 26 fuses in the event of fire, whereupon the spring relaxes, the pulley unwinds and the curtain closes, i.e., unfolds. When desired, the damper can be reopened, without replacement of the fusible link, by rotating the clutch until it engages a finger 30, whereupon the coil spring 28 tightens again around the pulley 20. Continued energization of the motor 16 causes the pulley to rotate and lift the curtain.

Figure 8:
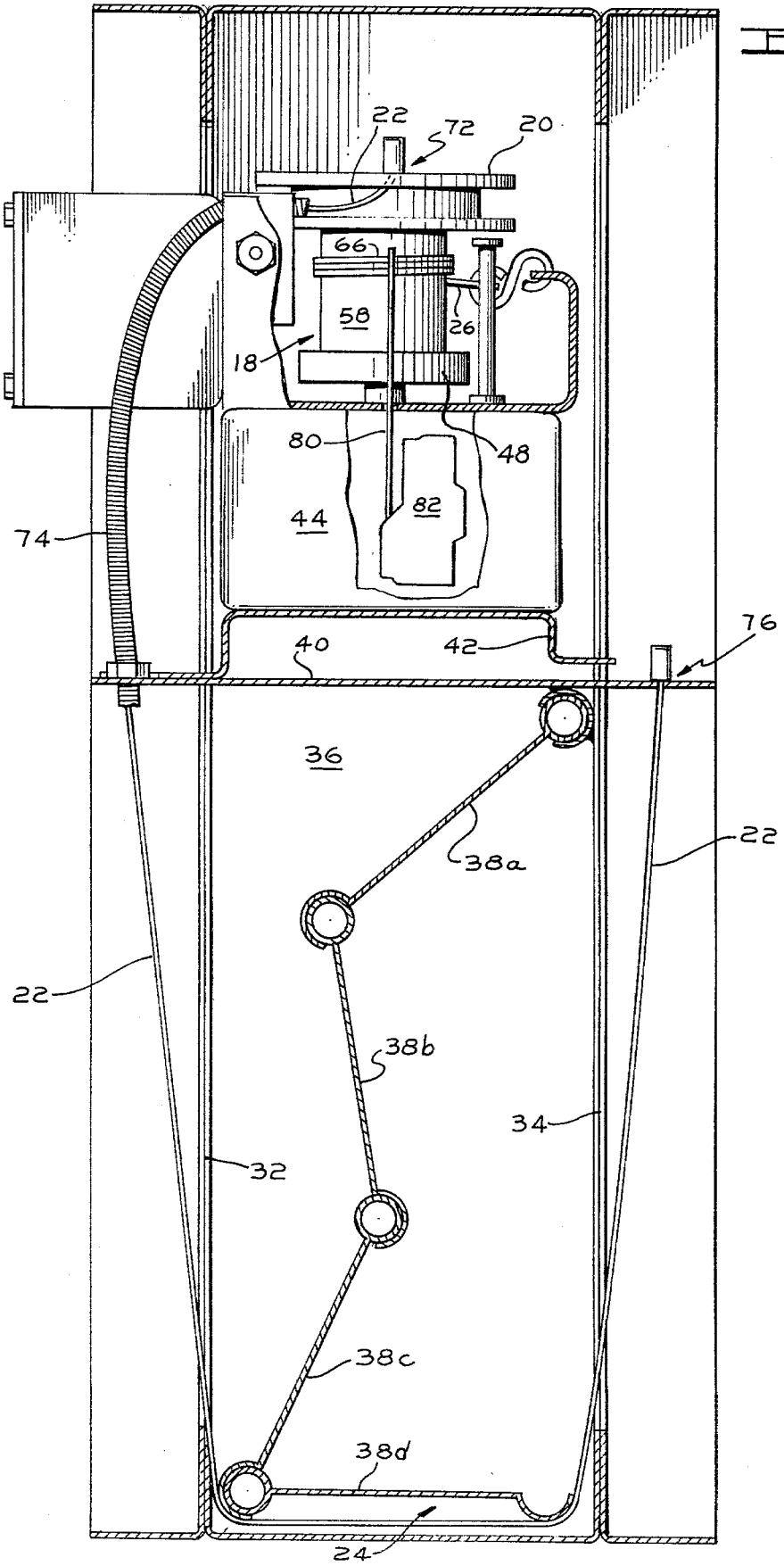
FIG. 8 is a fragmentary, side plan view of the damper which illustrates a cable used in conjunction with the spring clutch to open and close a multifold curtain of the damper.

In accordance with usual fire and smoke damper construction, the frame includes forward and rearward flanges 32, 34, which define an interior channel 36, within which the curtain is disposed. As best shown in FIGS. 2 and 8, the curtain includes a plurality of fire damper blades 38*a*, 38*b*, 38*c*, 38*d* that are pivotally interconnected at their horizontal, marginal edges. The uppermost blade 38*a* is pivotally attached to the bottom of a horizontally-extending flange 40 which is rigidly fixed to an upper portion of the frame 12.

The motor 16 is a stall point motor mounted on the upper surface of flange 40 by a bracket 42. As best seen in FIG. 1, the motor is contained in a motor housing 44 and is conventionally activated by electrical wiring 46. The motor has an output shaft (not shown) that is drivingly connected to the wrap spring clutch 18 by a conventional gearing arrangement (not shown) within the motor housing 44.

The wrap spring clutch 18 is commercially obtainable model ADC that is manufactured by PSI Division, Warner Electric Brake and Clutch Company. The clutch includes a spindle 48 driven by the motor output shaft. The spindle 48 comprises a spindle mounting shaft 50, fixed to a cylindrical base 52, and an input hub or stem 54 extending from the base and surrounding a portion of the mounting shaft 50. The stem 54 is provided with a notch which fixedly receives a turned end portion 56 or drive tang of the first coil spring 28. The first coil spring 28 is a one-way clutch spring that coils about the spindle stem 54, and is loose fit thereabout when untensioned.

A bushing or control collar 58 surrounds the first coil spring 28 with a notch which receives a second turned end portion 64 or control tang of the first coil spring. Thus, the spindle 48 and the bushing are interconnected by the first coil spring.

A second coil spring or actuating spring 66 has its body coiled around the outer surface of the bushing. The second spring has a tang 68 (see FIG. 6) that can be interconnected to the frame 12 by the fusible link 26.

The pulley 20 includes an integral stem or output hub 70 and is slidably mounted on the spindle shaft 50. Both the first coil spring 28 and the bushing 58 overlie the pulley stem 70.

As best shown in FIG. 8, the cable 22 is attached at one end 72 to the pulley, passes through a protection bushing or guide 74, loops around the bottom fire damper blade 38*d*, and is secured at its other end 76 to the flange 40.

In operation, the motor 16 is normally energized to rotate the spindle 48. Rotation of the spindle drives the clutch spring 28, i.e., the first coil spring. Through the drive tang 56, the control collar 58 is driven until the actuating spring 66, i.e., the second coil spring, restrained by the fusible link 26, winds down around the control collar and retards further movement of the collar. Continued rotation of the spindle causes the first coil spring to wrap down around both the spindle stem 54 and the pulley stem 70 whereupon torque is transmitted from the spindle to the pulley and the pulley starts to rotate. The pulley continues to rotate until the curtain 14 is raised to its FIG. 1 position to open the damper and associated duct. Once the curtain is fully raised, the stall motor 16 senses the load, stalls and locks the curtain in position. The motor is normally continuously energized by a continuous flow of electricity to maintain the curtain in its raised or opened position.

When the drive to the wrap spring clutch 18 is interrupted for any reason, the first coil spring 28 unwraps and disengages from the pulley hub 70. When the spring 28 relaxes, the pulley hub freewheels about the spindle mounting shaft 50 and the curtain 14 drops under its own weight, unwinding the cable 22 from the pulley 20. This automatically closes the damper opening 15 and can occur when current to the motor is interrupted or the fusible link 26 breaks.

In the event of fire, the fusible link fuses and breaks, whereupon the tang 68 is no longer restricted in its movement and the tensioned actuating spring 66 unwinds to free the control collar 58 and attached first coil spring 28 for rotational movement. The first coil spring unwinds, whereupon the pulley 20 freewheels and the curtain 14 automatically closes to prevent the passage of heat, smoke, fire or other dangerous conditions through the duct.

FIG. 10 illustrates an electrical circuit 78 used to de-energize the motor 16 after the link 26 has broken and the curtain 14 has automatically closed. When the link breaks, the motor is still energized and causes the spindle 48 to rotate until the tang 68 engages a flexible leaf 80 of a microswitch 82 (see FIG. 8 which has a portion of housing 44 broken away to illustrate the location of switch 82). Movement of the leaf 80 clicks the switch open (from its normally closed position shown in FIG. 10) so that the electrical current to the motor is interrupted. As shown in FIG. 10, the limit switch 82 is of the double pole, double throw type, one side thereof being normally open and the other side thereof normally closed.

When reopening of the duct is desired, the motor 16 is re-energized by closing a manually operated switch 86 (here, button operated) which completes the circuit 78. The motor then rotates spindle 48 until the tang 68 engages the finger or stop member 30 (see FIG. 7). Continued rotation of the spindle causes the first coil spring 28 to wrap down on the pulley hub 70 so that the pulley rotates to wind the cable 22 and lift the curtain.

While one version of the circuit 78 has been disclosed, it should be understood that the circuit lends itself to further refinement. For example, the circuit could include a light or buzzer (not shown) which indicates that switch 82 has opened and the curtain 14 has closed. Further, the switch 86 can be connected to a fire and/or smoke detector (not shown) which prevents the curtain from being reopened when fire or smoke is still present in the duct.

The preferred embodiment of the damper 10 is illustrated in FIGS. 11–12. This embodiment is preferred over the embodiment of FIGS. 1–10 because its fusible link 26 is located in the main air stream through the damper, where it can more readily sense the temperature in the duct. This insures a rapid fusing of the link (and automatic damper closure) upon the occurrence of extreme heat in the duct.

In FIGS. 11–12, elements similar to those disclosed in FIGS. 1–10 have been denoted by the same reference numerals. In this embodiment, the motor housing 44 is cantilevered from the top of frame 12 by an overhanging bracket 88 and the fusible link 26 is attached to an L-shaped bracket 90, which in turn is connected to the housing 44.

In each of the illustrated embodiments, the damper can be automatically closed by switching off the flow of electricity to the motor, which causes the spring clutch to unwind and the curtain to drop. By closing the damper in this manner, smoke can be prevented from entering a room when a fire in another area of the building has not yet generated enough heat to melt the fusible link. Further, by switching off the electricity, the damper can be closed to throttle heating or air conditioning from the duct.

In the illustrated embodiments, the finger 30 is a stationary post. In an alternate embodiment, the finger 30 is selectively movable into and out of engagement with the tang 68 by a solenoid (not shown). In such an embodiment, a reopened damper can be closed by either interrupting current to the motor 16 or withdrawing the finger from the tang 68.

In the embodiments of FIGS. 1–10 and 11–12, the shutter curtain 14 has been illustrated as a foldable curtain. Alternatively, though not shown, the shutter curtain can be a "multiblade" type that has blades which pivot at marginal edges to open and close the damper. With the "multiblade" curtain, a mechanical linkage and crank arm are used instead of the cable 22 and pulley 20 to open the damper.

Automatic closure of the "multiblade" curtain need not be achieved solely through gravity. A coil spring can be interconnected to the linkage and a stationary member such that the spring is tensioned by the crank arm when the curtain is opened and snaps back to its untensioned state when the drive to the modified wrap spring clutch 18 is interrupted. As the spring snaps back, it moves the linkage and automatically closes the curtain.

While different embodiments of the present invention have been expressly disclosed, it should be understood that obvious structural modifications can be made without departing from the spirit of the invention. For example, the automatically closed damper can be either a fire damper or a smoke damper instead of a combination fire and smoke damper. Accordingly, reference should be made primarily to the accompanying claims, rather than to the specification, to determine the scope of the invention.

Having thus described the invention, what is claimed is:

1. A fire and smoke damper of the type mounted within an air duct and movable from an open position which defines a duct opening to a closed position wherein the duct opening is closed, comprising:

(a) a pulley;

(b) a motor adapted to rotate the pulley;

(c) clutch means for transmitting torque from the motor to the pulley to rotate the pulley, said means including a coil spring surrounding a portion of the pulley;

(d) a curtain movable from a first position wherein the duct opening is closed to a raised position wherein the duct opening is open;

(e) cable means for raising and lowering the curtain to open and close the duct opening, said cable means including a cable windable about the pulley;

(f) primary stop means including a stationary member and a fusible link interconnecting the member and the clutch means to restrict a portion of the spring and permit the spring to wrap down on said portion of the pulley to transmit torque from the motor to the pulley to raise the curtain; and (g) secondary stop means for restricting the spring portion to permit the spring to wrap down on said pulley portion and transmit torque to raise the curtain when the stationary member and the clutch means are not interconnected by the fusible link.

2. The fire and smoke damper of claim 1 wherein the cable is looped around a portion of the curtain and is connected to the pulley.

3. A fire and smoke damper of the type mounted within an air duct and movable from an open position which defines a duct opening to a closed position wherein the duct opening is closed, comprising:

(a) a spindle having an input hub;

(b) a motor adapted to rotate the spindle;

(c) a pulley rotatable about the spindle, said pulley including an output hub adjacent the spindle input hub;

(d) clutch means including a coil spring, surrounding a portion of the stem and a portion of the output hub, for transmitting torque from the input hub to the output hub to rotate the pulley;

(e) a curtain movable from a fist position wherein the duct opening is closed to a raised position wherein the duct opening is open;

(f) cable means for raising and lowering the curtain to open and close the duct, said means including a cable windable about the pulley;

(g) primary stop means including a stationary member and a fusible link interconnecting the member and the clutch means to restrict a portion of the spring and permit the spring to wrap down on both the input and output hubs to transmit torque from the input hub to the output hub to raise the curtain; and (h) secondary stop means for restricting the spring portion to permit the spring to wrap down on both the input and output hubs and transmit torque to raise the curtain when the stationary member and the clutch means are not interconnected by the fusible link.

4. The fire and smoke damper of claim 3 wherein the cable is looped around a portion of the curtain and is connected to the pulley.

5. The fire and smoke damper of claim 3 wherein the spring has a portion fixedly connected to the spindle.

6. The fire and smoke damper of claim 3 wherein the clutch means includes:

(a) a bushing surrounding a portion of the spring and rotatable relative to the input and output hubs;

(b) a second coil spring surrounding a portion of the bushing, and (c) wherein the portion of the clutch means to which the fusible link is connected is a tang of the second coil spring.

7. The fire and smoke damper of claim 6 wherein the secondary stop means includes a second stationary member adapted to abut and prevent movement of the tang.

8. In a fire or smoke damper, mounted within an air duct, of the type having a frame and a curtain movable from an open position which defines a duct opening to a closed position wherein the duct opening is closed, and further of the type having a one-way wrap spring clutch with an input hub, clutch spring, control collar, actuating spring, and output hub, the improvement comprising:

(a) a fusible link adapted to interconnect the actuating spring and a stationary member; and (b) a stop member adapted to abut a tang of the actuating spring when the damper frame and the actuating spring are not interconnected by the fusible link.

9. The fire or smoke damper of claim 8 wherein the stationary member is the damper frame.

10. A fire or smoke damper of the type having a curtain movable between an open position which defines an opening in the damper and a closed position wherein the damper opening is closed, comprising:

(a) a wrap spring clutch including an input hub, an output hub, and a coil spring, said output hub being operatively connected to means for moving said curtain;

(b) a motor adapted to rotate the input hub;

(c) primary stop means including a stationary member and a fusible link interconnecting the member and the clutch to restrict a portion of the spring and permit the spring to wrap down on both the input and output hubs to transmit torque from the input hub to the output hub to move said curtain; and, (d) secondary stop means for restricting a portion of the spring to permit the spring to wrap down on both the input and output hubs and transmit torque to move said curtain when the stationary member and the clutch are not interconnected by the fusible link.

* * * * *

UNITED STATES PATENT AND TRADEMARK OFFICE

CERTIFICATE OF CORRECTION

PATENT NO. : 4,334,570

DATED : June 15, 1982

INVENTOR(S) : Rudolph J. Adams

It is certified that error appears in the above-identified patent and that said Letters Patent is hereby corrected as shown below:

Claim 3, line 20:

(e)a curtain movable from a fist position wherein the .....

should read:

(e)a curtain movable from a first position wherein the .....

Signed and Sealed this

*Third* Day of *August 1982*

[SEAL]

*Attest:*

GERALD J. MOSSINGHOFF

*Attesting Officer*

*Commissioner of Patents and Trademarks*